United States Patent [19]

Heiniger

[11] 4,185,666

[45] Jan. 29, 1980

[54] ADJUSTING DEVICE IN THE CONNECTING PATH BETWEEN A SHED-FORMING DEVICE AND A HEDDLE FRAME

[75] Inventor: Kurt Heiniger, Horgen-Zuerich, Switzerland

[73] Assignee: Staeubli Ltd., Horgen-Zurich, Switzerland

[21] Appl. No.: 924,704

[22] Filed: Jul. 14, 1978

[30] Foreign Application Priority Data

Jul. 20, 1977 [CH] Switzerland ..... 8910/77

[51] Int. Cl.[2] ..... D03C 13/00

[52] U.S. Cl. ..... 139/82

[58] Field of Search ..... 139/57, 66 R, 66 A, 139/82, 83, 84, 88, 91, 92

[56] References Cited

U.S. PATENT DOCUMENTS

| | | | |
|---|---|---|---|
| 1,931,269 | 10/1933 | Randall | 139/66 R |
| 2,506,564 | 5/1950 | Blanchard | 139/82 |
| 3,741,257 | 6/1973 | Kleiner et al. | 139/88 |
| 3,759,298 | 9/1973 | Kaufmann | 139/82 |
| 4,088,158 | 5/1978 | Kennedy | 139/92 |

*Primary Examiner*—Henry Jaudon

*Attorney, Agent, or Firm*—Blanchard, Flynn, Thiel, Boutell & Tanis

[57] ABSTRACT

An adjusting device in the connecting path between the jack lever of a dobby and the power transmitting rod to the heddle frame of a weaving machine. This adjusting device has at most the width of the pitch of the weaving machine. The clamping and adjusting screws on the adjusting device are on the front side which does not face the dobby. For the purpose of cancelling any clearance in the connection, wedges are arranged, which hold the clamp in the fixed position. With the aid of the clamp it is possible to adjust the size of the opening and the reciprocal position of the heddle frames.

12 Claims, 8 Drawing Figures

87
71
70
VII
VI
97
95
50
96
V
60
53
72
IV
18
80
8
10
17
73
5
95
7
6
50
3

5
6
60
50
7
53
3

87
70
95
96
6
60
72
8
97
50
7
53
3

6
60
7
50

95
7
96
95
50

70
7
50
71
73

18
10
17

ADJUSTING DEVICE IN THE CONNECTING PATH BETWEEN A SHED-FORMING DEVICE AND A HEDDLE FRAME

FIELD OF THE INVENTION

The invention relates to an adjusting device in the connecting path between the back and forth swinging jack lever of a shed-forming device and a heddle frame or a heddle or a weaving machine, in which device an adjusting member is positioned movably, adjustably and securably on the jack lever in two directions which are perpendicular to one another, which jack lever penetrates through the adjusting member in a guideway transversely with respect to its longitudinal axis, and which adjusting member has a swivel bearing for connecting the connecting rod to the heddle frame mechanism.

BACKGROUND OF THE INVENTION

Such an adjusting device with an adjusting member has become known from U.S. Pat. No. 3,741,257. The constantly increasing operating speeds due to an increase of the weft number per minute in weaving machines has shown a stronger stress on the individual elements thereof, which manifests itself in the wear of the parts and causes chattering due to improper clearance problems. The tensioning by canting, which is suggested in the modified embodiments, has proven not to be sufficiently resistant for higher stresses. As a modification, it has been suggested to additionally secure the tensioning of the canting by the engagement of two tooth systems. This, however, has the disadvantage that a stepless adjustment is not possible.

The purpose of the invention is an adjusting device, which no longer has the above-mentioned disadvantages and the adjusting and the clamping screw lie still in the active direction of the lever force and are readily accessible for operation from the front side.

This is achieved inventively in the above-mentioned adjusting device by the adjusting member being constructed as a sleeve membe with a U-shaped band which is arranged therein and grips around the jack lever from three sides and the ends of which band are connected to one another through a block member, whereby between the block member and the jack lever bracing means are arranged, which are supported during bracing between the block member and jack lever on the wall of the sleeve member.

BRIEF DESCRIPTION OF THE DRAWINGS

One exemplary embodiment of the subject matter of the invention is illustrated in the drawings, in which.

DETAILED DESCRIPTION

Figure 1:
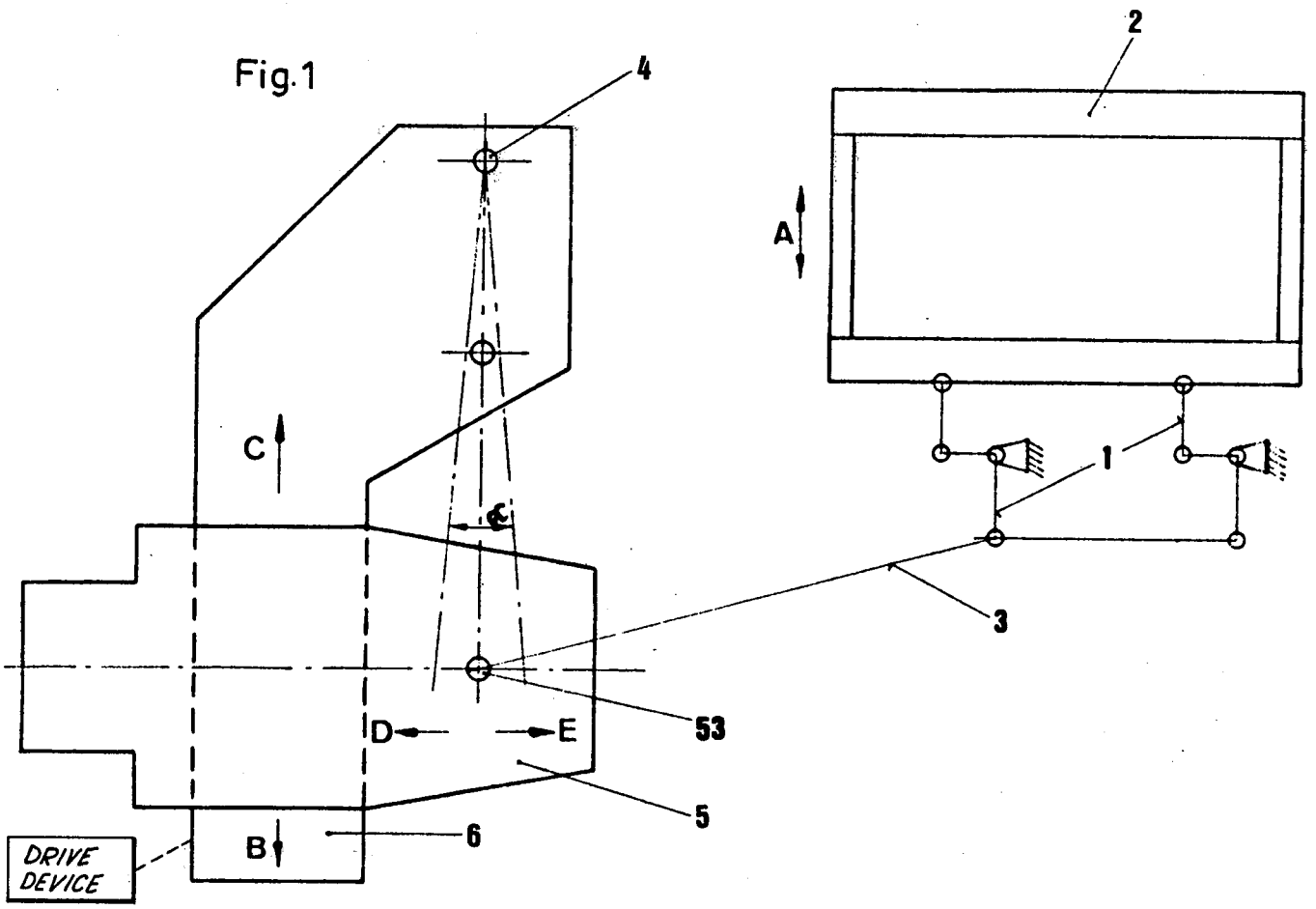
FIG. 1 is a schematic illustration of an arrangement of an adjusting device embodying the invention.
Figure 2:
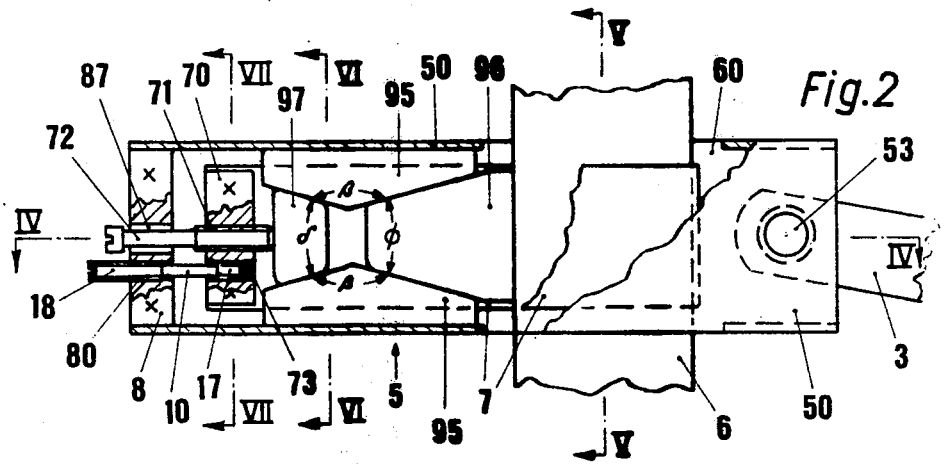
FIG. 2 is a partially cross-sectioned side view of a mounted adjusting member.
Figure 3:
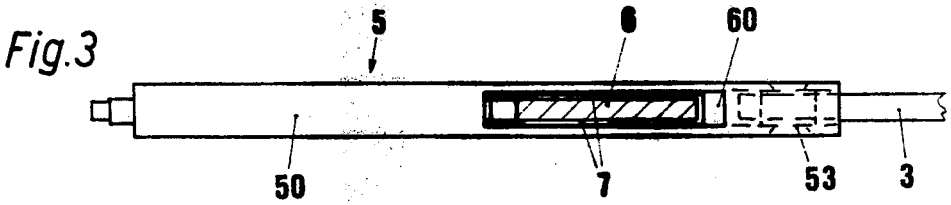
FIG. 3 is a top view of the adjusting member according to FIG. 2.
Figure 4:
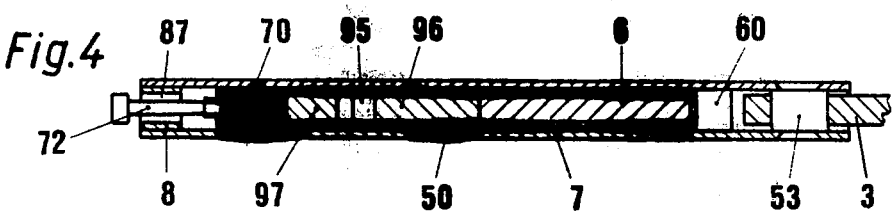
FIG. 4 is a cross-sectional view taken along the line IV—IV of FIG. 2.
Figure 5:
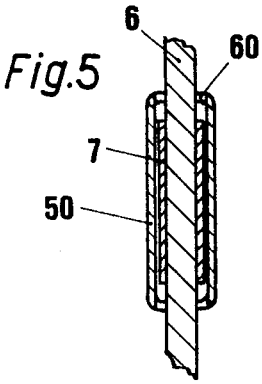
FIGS. 5, 6 and 7 are each cross-sectional views taken, respectively, along the lines V—V, VI—VI and VII—VII of FIG. 2.
Figure 6:
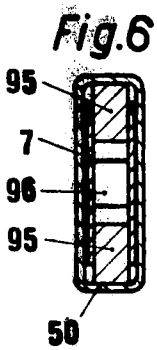
Figure 7:
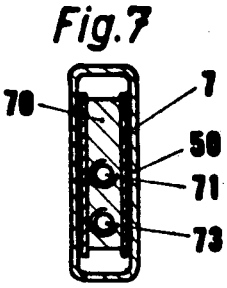
Figure 8:
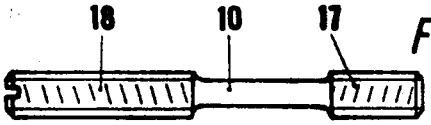
FIG. 8 is a view of the adjusting screw.

Referring first to the schematic illustration in FIG. 1, a pair of lever drive members 1 are hingedly connected at one end to a heddle frame 2 of a weaving machine and at the other end through a connecting rod 3, a load bearing member 53 and an adjusting member 5 which is slidably supported on a jack lever 6 to a not shown shed-forming device. The jack lever 6 is driven by a drive mechanism in the dobby for back and forth (left and right) movement in the usual manner. The arm 6 forms a portion of the shed-forming device. The angle of traverse of the jack lever, which angle is identified with the symbol $\alpha$ in FIG. 1, has its center at a fulcrum point 4 and results in path A of movement for the heddle frame, which path is required for weaving, namely the heddle frame is moved up and down, hereinafter referred to as heddle frame lift. The dimension of the angle $\alpha$ is determined by the structure of the shed-forming device. If, for example, the heddle frame movement is to be enlarged, then it is sufficient to move the adjusting member 5 in direction B on the arm 6. To decrease the magnitude of the heddle frame lift A, the member 5 is moved in direction C. An ajustment of the heddle frame 2, however, must not only take place with respect to its lift A, but the heddle frame must be adjustable also with respect to its basic position. This can be achieved by the load bearing member 53 being moved along the adjusting member 5 with respect to the arm 6 in the directions D or E.

As is known, the thickness of the heddle frames, the so-called pitch, is standardized and is maintained as small as possible, so that as many heddle frames as possible can be mounted in the weaving machine. The entire shed-forming device and thus also the adjusting device according to the invention must lie within this pitch. This requires special arrangements of the adjusting devices, the clamping or locking devices, as they are described for example in the following exemplary embodiment.

The adjusting member 5 consists of a sleeve member 50 having a rectangular cross section and a guide opening 60 extending transversely thereof and in which is received the jack lever 6. The lever 6 has on three sides thereof a band 7 of sheet metal, which band is arranged in the sleeve member 50 and is U-shaped. A block member 70 is positioned between and fixedly connected to the two ends of the two legs of the band 7.

One end of the hollow sleeve member 50 has an end member 8 fixedly secured therein, while at the other end there is the load bearing member 53 pivotally connected to the connecting rod 3 which in turn is connected to the heddle frame.

Four wedges are provided in the sleeve member 50 and in the U-shaped band, namely, the back side of a first and second clamping or pressure wedges 95 each engage a narrow side of the sleeve member and the two wedge surfaces on each thereof are directed toward the inside of the sleeve member and form an obtuse angle $\beta$, and the back side of a third expanding wedge 96 engages the jack lever and the wedge surfaces thereof form an acute angle $\phi$ therebetween and converge toward the end member 8 and the backside of a fourth expanding wedge 97 is directed toward the block member 70 and the wedge surfaces thereof form an acute angle $\delta$ therebetween and converge toward the third wedge 96. The third expanding wedge 96 and the fourth expanding wedge 97 lie each between the first and second clamping wedges 95 and their wedges surfaces rest on one another. A screw 72 is threadedly engaged with and adjustable with respect to the block member 70. One end of the screw engages the wedge 97. The contact pressure of the wedges 95 on the narrow sides of the sleeve member 50, which pressure is initiated by the screw 72 and the wedge 96 on the jack lever 6 can be influenced among one another by selecting the wedge angle so that the sleeve member 50 and the band 7 form with respect to one another and as a whole with respect to the jack lever 6 a fixedly braced and rigid unit, which is necessary in order to effectively transfer the forces between the connecting rod 3 and the jack lever 6.

The screw 72 is received in a central, through-going internally threaded hole 71 provided in the block member 70. The head end of the screw is operatively adjusted through an opening 87 in the end member 8. Another internally threaded opening 73 is provided in the block member 70. The thread 17 of an adjusting double screw 10 is received in the opening 73 while the other threaded end 18 of the screw 10 is received in an internally threaded opening 80 in the end member 8. In the case of the two threads 17, 18 on the screw 10, one is a left-hand thread and the other is a right-hand thread. The two threads 17, 18 can also have a different pitch.

To adjust the basic position of the heddle frame—which is done by changing the distance between the load bearing member 53 and the jack lever 6—the adjusting screw 10 is operated, so that the entire band 7 and thus the arm 6 change their position in the sleeve member 50.

To adjust the magnitude of the heddle frame lift, the pressure screw 72 is released. As a result, the reciprocal press power of the first loosely placed-in four wedges 95, 96, 97 and the band 7 loosen up around the jack lever 6 and the entire adjusting member 5 can be moved upwardly or downwardly on the jack lever. The swivelling which is taken from the adjusting member 5 and is transmitted to the heddle frame 2 is reduced or enlarged in size.

As is shown by the figures, both screws 18, 72 are accessible from the backside of the adjusting member 5, namely they lie within the pitch of the weaving machine and the dobby.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an adjusting device in the connecting path between a pivotally supported jack lever of a shed-forming device and a heddle of a weaving machine, said adjusting device having an elongated adjusting member adjustably and lockably positioned on said jack lever and movable in two directions which are perpendicularly related with respect to one another, said adjusting member having a guideway thereon extending transversely to its longitudinal axis and receives said jack lever therethrough in one of said two directions, said adjusting member further having a swivel bearing for connection to said heddle, the improvement comprising wherein said adjusting member is constructed as a sleeve member having a U-shaped band arranged therein which grips around said jack lever on three sides, the ends of the legs of said band being connected to a block member, wherein between said block member and said jack lever plural wedges are arranged, said plural wedges being supported on a wall of said sleeve member when a rigid bracing occurs between said block member and said jack lever, and wherein first adjusting means on said block member is operatively connected to said wedges for rigidifying the position of said jack lever relative to said block member thereby preventing relative movement in said one direction, and second adjusting means is provided for varying the spacing between said end member and said block member for facilitating an adjusting of the position of said swivel bearing with respect to said jack lever and along said other of said two directions.

2. The improved adjusting device according to claim 1, wherein said plural wedges include four wedges arranged between the legs of said band and said sleeve member, said four wedges including two pressure wedges being arranged on an interior wall of said sleeve member and having two sloped surfaces which extend inclined to one another, between which sloped surfaces on two opposed ones of said pressure wedges there is arranged two further expanding wedges, and wherein one of these expanding wedges engages said jack lever and the other of these expanding wedges engages said first adjusting means on said block member.

3. The improved adjusting device according to claim 2, wherein said first adjusting means includes a screw threadedly engaged in an opening in and extending through said block member, said screw having a head at one end which is accessible at one end of said sleeve member and can be operated therefrom, the other end of said screw engaging said other expanding wedge.

4. The improved adjusting device according to claim 2, wherein said inclined surfaces on each of said pressure wedges form an obtuse angle to one another and the wedge surfaces on said expanding wedges form an acute angle to one another, and each wedge surface on each pressure wedge engages a mutually adjacent wedge surface on an expanding wedge.

5. The improved adjusting device according to claim 1, wherein said second adjusting means includes an end member which closes off at least partly one end of said sleeve member, and further includes a means for varying the spacing between said end member and said block member for facilitating an adjusting of the position of said swivel bearing with respect to said jack lever and along said other of said two directions.

6. The improved adjusting device according to claim 5, wherein said means for varying the spacing between said block member and said end member to effect a varying of the basic position of said heddle consists of an internally threaded opening in both of said block member and said end member, said openings being in axial alignment and receiving an adjusting screw therein, said adjusting screw having two thread sets thereon operatively coupled to the respective one of said internal threads in said openings.

7. The improved adjusting device according to claim 6, wherein said two thread set are of a different pitch.

8. The improved adjusting device according to claim 6, wherein said two thread sets are oppositely threaded to one another.

9. The improved adjusting device according to claim 5, wherein said first adjusting means includes a screw threadedly engaged in an opening in and extending through said block member, an opening in said end member axially aligned with said opening in said block member, said screw having a head at one end which extends through said opening in said end member and is accessible at said one end, the other end of said screw engaging said one of said wedges.

10. The improved adjusting device according to claim 1, wherein said sleeve member has a rectangular cross section.

11. The improved adjusting device according to claim 1, wherein said band consists of a metal material.

12. In an adjusting device in the connecting path between a pivotally supported jack lever of a shed-forming device and a heddle of a weaving machine, said adjusting device having an elongated adjusting member adjustably and lockably positioned on said jack lever and movable in two directions which are perpendicularly related with respect to one another, said adjusting member having a guideway thereon extending transversely to its longitudinal axis and receiving said jack lever therethrough in one of said two directions, said adjusting member further having a swivel bearing for connection to said heddle, the improvement comprising wherein said adjusting member is constructed as a sleeve member having a U-shaped band arranged therein which grips around said jack lever on three sides, the ends of the legs of said band being connected to a block member, wherein between said block member and said jack lever plural wedges are provided which are supported on each other and on a wall of said sleeve member when a rigid bracing occurs between said block member and said jack lever and adjusting means on said block member operatively connected to one of said plural wedges for effecting said rigid bracing.

* * * * *